US007392811B2

(12) United States Patent
Staub et al.

(10) Patent No.: US 7,392,811 B2
(45) Date of Patent: Jul. 1, 2008

(54) DELIVERY HEAD FOR MULTIPLE PHASE TREATMENT COMPOSITION, VESSEL INCLUDING A DELIVERY HEAD, AND METHOD FOR TREATING A VESSEL INTERIOR SURFACE

(75) Inventors: Richard K. Staub, Lakeville, MN (US); Mark R. Altier, St. Paul, MN (US); Paul F. Schacht, Oakdale, MN (US); Robert D. P. Hei, Baldwin, WI (US); Gabriel M. Miller, Lodi, WI (US); Thomas L. Harris, Eden Prairie, MN (US); Peter J. Fernholz, Burnsville, MN (US)

(73) Assignee: Ecolab Inc., St. Paul, MN (US)

( * ) Notice: Subject to any disclaimer, the term of this patent is extended or adjusted under 35 U.S.C. 154(b) by 361 days.

(21) Appl. No.: 10/786,237

(22) Filed: Feb. 23, 2004

(65) Prior Publication Data

US 2005/0187122 A1 Aug. 25, 2005

(51) Int. Cl.
*B08B 9/02* (2006.01)

(52) U.S. Cl. ..... 134/22.1; 134/22.12; 134/36

(58) Field of Classification Search ..... 134/22.1, 134/22.12, 36

See application file for complete search history.

(56) References Cited

U.S. PATENT DOCUMENTS 3,794,169 A 2/1974 Sisk et al.
3,802,390 A 4/1974 Blair et al.
3,840,402 A 10/1974 Tobin, III
3,912,624 A 10/1975 Jennings
3,992,301 A 11/1976 Shippey et al.
4,153,545 A 5/1979 Zwack et al.

(Continued)

FOREIGN PATENT DOCUMENTS

AU 8934601 11/1989

(Continued)

OTHER PUBLICATIONS

"AirFlush® processing: Minimise chemicals by AIR-enhanced membrane cleaning," http://www.xflow.nl/english/concepten/airflush.html, 3 pages (Date Printed Feb. 15, 2002).

(Continued)

*Primary Examiner*—Gregory E Webb
(74) *Attorney, Agent, or Firm*—Andrew D. Sorensen; Anneliese S. Mayer; Amy J. Hoffman

(57) ABSTRACT

A delivery head is provided that includes a delivery arm and a spray diverter constructed to divert a multiple phase treatment composition flowing through the delivery arm and diverted by the spray diverter to provide a target spray pattern. The delivery head includes an open area sufficient to provide the target spray pattern and to provide a back pressure of less than about 10 psig when a multiple phase treatment composition is flowing through the delivery head at a liquid flow rate of about 2 gal/min. to about 20 gal/min., and the volumetric ratio of the gas to liquid is between about 5:1 and about 75,000:1 at atmospheric pressure. A vessel including a delivery head and a method for treating a vessel interior surface are provided.

16 Claims, 6 Drawing Sheets

U.S. PATENT DOCUMENTS

| | | | | |
|---|---|---|---|---|
| 4,222,871 | A | 9/1980 | Lefeuvre | |
| 4,224,963 | A | 9/1980 | Stahle | |
| 4,244,820 | A | 1/1981 | Hauk et al. | |
| 4,299,121 | A | 11/1981 | Asayama et al. | |
| 4,409,088 | A | 10/1983 | Kanno et al. | |
| 4,482,514 | A | 11/1984 | Schindler et al. | |
| 4,624,760 | A | 11/1986 | Pottinger et al. | |
| 4,740,308 | A | 4/1988 | Fremont et al. | |
| 4,787,304 | A * | 11/1988 | Bronnert | 99/453 |
| 4,792,401 | A | 12/1988 | Truex et al. | |
| 4,801,375 | A | 1/1989 | Padilla | |
| 4,871,683 | A | 10/1989 | Harris et al. | |
| 4,923,609 | A | 5/1990 | Jardine | |
| 4,943,374 | A | 7/1990 | Heininger et al. | |
| 5,028,329 | A | 7/1991 | Drioli et al. | |
| 5,039,324 | A | 8/1991 | Goldberg | |
| 5,147,309 | A | 9/1992 | Hemmerich et al. | |
| 5,169,412 | A | 12/1992 | Prasad et al. | |
| 5,171,446 | A | 12/1992 | Shen | |
| 5,221,477 | A | 6/1993 | Melcher et al. | |
| 5,242,046 | A | 9/1993 | Bailey | |
| 5,395,429 | A | 3/1995 | Sutsko et al. | |
| 5,456,843 | A | 10/1995 | Koenhen | |
| 5,560,828 | A | 10/1996 | Wenten et al. | |
| 5,603,826 | A * | 2/1997 | Welch | 210/195.1 |
| 5,605,628 | A | 2/1997 | Davidson et al. | |
| 5,690,830 | A | 11/1997 | Ohtani et al. | |
| 5,783,245 | A * | 7/1998 | Simpson, II | 426/580 |
| 5,801,051 | A | 9/1998 | Kiefer et al. | |
| 5,941,257 | A * | 8/1999 | Gruszczynski, II | 134/22.11 |
| 6,004,374 | A | 12/1999 | Rao et al. | |
| 6,027,572 | A | 2/2000 | Labib et al. | |
| 6,071,356 | A | 6/2000 | Olsen | |
| 6,112,908 | A | 9/2000 | Michaels | |
| 6,158,721 | A | 12/2000 | Katou et al. | |
| 6,161,250 | A | 12/2000 | Young et al. | |
| 6,174,351 | B1 | 1/2001 | McDowell et al. | |
| 6,183,708 | B1 * | 2/2001 | Hei et al. | 423/210 |
| 6,197,203 | B1 | 3/2001 | Ishida et al. | |
| 6,197,739 | B1 | 3/2001 | Oakes et al. | |
| 6,214,231 | B1 | 4/2001 | Cote et al. | |
| 6,261,457 | B1 | 7/2001 | Wenthold et al. | |
| 6,280,626 | B1 | 8/2001 | Miyashita et al. | |
| 6,288,222 | B1 | 9/2001 | Roth et al. | |
| 6,326,340 | B1 | 12/2001 | Labib et al. | |
| 6,351,864 | B1 | 3/2002 | Karafa et al. | |
| 6,355,173 | B1 | 3/2002 | den Bieman et al. | |
| 6,365,005 | B1 * | 4/2002 | Schleiffarth | 203/1 |
| 6,387,189 | B1 | 5/2002 | Gröschl et al. | |
| 6,402,956 | B1 | 6/2002 | Andou et al. | |
| 6,454,871 | B1 * | 9/2002 | Labib et al. | 134/8 |
| 6,485,762 | B1 | 11/2002 | Rizvi et al. | |
| 6,499,606 | B1 | 12/2002 | Grangeon et al. | |
| 6,515,115 | B1 | 2/2003 | Kwant et al. | |
| 6,524,481 | B2 | 2/2003 | Zha et al. | |
| 6,619,302 | B2 | 9/2003 | Labib et al. | |
| 2002/0112743 | A1 | 8/2002 | Tabani et al. | |
| 2004/0007255 | A1 * | 1/2004 | Labib et al. | 134/30 |

FOREIGN PATENT DOCUMENTS

| | | | |
|---|---|---|---|
| CN | 1221648 | | 7/1999 |
| DE | 2818127 | A1 | 11/1978 |
| DE | 3818919 | | 12/1989 |
| DE | 4101045 | | 8/1991 |
| DE | 4109732 | | 10/1992 |
| DE | 4226673 | | 2/1994 |
| DE | 19724172 | A1 | 12/1998 |
| DE | 19730441 | A1 | 1/1999 |
| DE | 10004863 | A1 | 2/2001 |
| DE | 19920269 | A1 | 3/2001 |
| EP | 301597 | | 2/1989 |
| EP | 0 490 117 | A1 | 6/1992 |
| EP | 0 160 014 | B1 | 1/1993 |
| EP | 526372 | A1 | 2/1993 |
| EP | 645174 | A1 | 3/1995 |
| EP | 0 970 922 | A2 | 1/2000 |
| FR | 2707520 | A1 | 1/1995 |
| FR | 2727787 | A1 | 6/1996 |
| JP | 51071880 | A2 | 6/1976 |
| JP | 52058078 | A2 | 5/1977 |
| JP | 53108882 | | 9/1978 |
| JP | 54067574 | | 5/1979 |
| JP | 55049887 | B4 | 12/1980 |
| JP | 56024006 | | 3/1981 |
| JP | 56015924 | B4 | 4/1981 |
| JP | 61153104 | A2 | 7/1986 |
| JP | 61192309 | A2 | 8/1986 |
| JP | 63104610 | A2 | 5/1988 |
| JP | 63126513 | A2 | 5/1988 |
| JP | 63147506 | | 6/1988 |
| JP | 01104309 | | 4/1989 |
| JP | 01262903 | | 10/1989 |
| JP | 01262904 | | 10/1989 |
| JP | 02183749 | | 7/1990 |
| JP | 03042018 | | 2/1991 |
| JP | 04317726 | | 11/1992 |
| JP | 05277345 | | 10/1993 |
| JP | 06023246 | | 2/1994 |
| JP | 07000770 | A2 | 1/1995 |
| JP | 07246320 | A2 | 9/1995 |
| JP | 07313851 | A2 | 12/1995 |
| JP | 09108670 | A2 | 4/1997 |
| JP | 09117647 | | 5/1997 |
| JP | 09262442 | A2 | 5/1997 |
| JP | 10052377 | A2 | 2/1998 |
| JP | 10057957 | A2 | 3/1998 |
| JP | 10085562 | A2 | 4/1998 |
| JP | 11057415 | | 3/1999 |
| JP | 11077042 | A2 | 3/1999 |
| JP | 11104636 | A2 | 4/1999 |
| JP | 11165186 | A2 | 6/1999 |
| JP | 11169684 | | 6/1999 |
| JP | 11197685 | A2 | 7/1999 |
| JP | 11256193 | | 9/1999 |
| JP | 11309346 | A2 | 11/1999 |
| JP | 2000000598 | | 1/2000 |
| JP | 2000051670 | A2 | 2/2000 |
| JP | 2000061273 | | 2/2000 |
| JP | 2000325758 | A2 | 11/2000 |
| JP | 2001038164 | A2 | 2/2001 |
| JP | 2001079366 | | 3/2001 |
| JP | 2001104760 | | 4/2001 |
| JP | 2001145676 | | 5/2001 |
| JP | 2001205055 | | 7/2001 |
| JP | 2001259384 | | 9/2001 |
| KR | 2001018168 | | 3/2001 |
| RU | 2033579 | | 4/1995 |
| RU | 2046080 | | 10/1995 |
| SU | 743691 | | 7/1980 |
| SU | 948386 | | 8/1982 |
| SU | 1350434 | | 11/1987 |
| SU | 1532099 | | 12/1989 |
| SU | 1701358 | A1 | 12/1991 |
| WO | WO 9517526 | A1 | 6/1995 |
| WO | WO 9733832 | A1 | 9/1997 |
| WO | WO 0018498 | A1 | 4/2000 |

OTHER PUBLICATIONS

Allen, V. et al., "Test program for physical cleaning and fouling prevention in reverse osmosis systems," *Report*, CEL-CR-78.010, Order AD-A055624 (1978) (1 page abstract).

Balek, W., "Overview of Food Safety Regulation in the United States," *International Sanitary Supply Association*, pp. 1-8 (Mar. 30, 2001).
Bellara, S. et al., "Gas Sparging to enhance permeate flux in ultrafiltration using hollow fibre membranes," *Journal of Membrane Science*, vol. 121, No. 2, pp. 175-184 (Dec. 11, 1996) (1 page abstract).
Bellara, S. et al., "Flux enhancement in hollow fiber membrane systems," *IChemE Res. Event, Eur. Conf. Young Res. Chem. Eng., 2nd*, vol. 1, pp. 310-312 (1996) (1 page abstract).
Bodzek, M., "Membrane techniques in air cleaning," *Pol. J. Environ. Stud.*, vol. 9, No. 1, pp. 1-12 (2000) (1 page abstract).
Bouhabila, E. et al., "Microfiltration of activated slude using submerged membrane with air bubbling (application to wastewater treatment)," *Desalination*, vol. 118, Nos. 1-3, pp. 315-322 (1998) (1 page abstract).
Bouhabila, E. et al., "Fouling characterization in membrane bioreactors," *Separation and Purification Technology*, vol. 22 and 23, Nos. 1-3, pp. 123-132 (2001) (1 page abstract).
Bourcier, W. et al., "Pretreatment of oil field and mine waste waters for reverse osmosis," *Environ. Sci. Res.*, vol. 52, pp. 509-519 (1996) (1 page abstract).
Cabassud, C. et al., "Flux enhancement by a tangential gas flow in ultrafiltration hollow fibers for drinking water production," *Proc.-World Filrt. Congr., 7th*, vol. 2, pp. 496-500 (1996) (1 page abstract).
Cabassud, C. et al., "How slug flow can improve ultrafiltration flux in organic hollow fibres," *Journal of Membrane Science*, vol. 128, pp. 93-101 (1997).
Cabassud, C. et al., "Air sparging in ultrafiltration hollow fibers: relationship between flux enhancement, cake characteristics and hydrodynamic parameters," *Journal of Membrane Science*, vol. 181, No. 1, pp. 57-69 (Jan. 15, 2001) (1 page abstract).
Chakma, A., "Separation of CO2 and SO2 from flue gas streams by liquid membranes," *Energy Convers. Manage.*, vol. 36, Nos. 6-9, pp. 405-410 (1995) (1 page abstract).
Chang, S. et al., "Characteristics of microfiltration of Suspensions with inter-fiber two-phase flow," *Journal of Chemical Technology & Biotechnology*, vol. 75, No. 7, pp. 533-540 (2000) (1 page abstract).
Cheng, T. et al., "Effects of gas slugs and inclination angle on the ultrafiltration flux in tubular membrane module," *J. Membr. Sci.*, vol. 158, Nos. 1-2, pp. 223-234 (1999) (1 page abstract).
Cheng, T., "Influence of inclination on gas-sparged crossflow ultrafiltration through an inorganic tubular membrane," *Journal of Membrance Science*, vol. 196, No. 1, pp. 103-110 (2002) (1 page abstract).
Chevyan, M., "Introduction. Definition and Classification of Membrane Separation Processes," *Ultrafiltration and Microfiltration Handbook*, 22 pages (1998).
Cui, Z. et al., "Flux enhancements with gas sparging in downwards crossflow ultrafiltration: performance and mechanism," *J. Membr. Sci.*, vol. 117, Nos. 1-2, pp. 109-116 (1996) (1 page abstract).
Cui, Z. et al., "Airlift crossflow membrane filtration—a feasibility study with dextran ultrafiltration," *Journal of Membrane Science*, vol. 128, No. 1, pp. 83-91 (May 28, 1997) (1 page abstract).
Cui, Z. et al., "Water Treatment with Membranes and Membrane Bioreactors," http://www.eng.ox.ac.uk.World/Research/Summary/B-Biotech.html, 1 page (May 17, 2002).
"Desal™ Membrane Products, Food & Dairy Sanitary Ultrafiltration PES—10,000 MWCO," *Osmonics*, 2 pages, date unknown.
"Desal® Membrane Products, Dairy Processing Sanitary Ultrafiltration PES—10,000 MWCO," http://www.osmonics.com/Literature/Literature.asp?G=31, 2 pages (Date Printed Mar. 12, 2003).
Duin, O. et al., "Direct nanofiltration or ultrafiltration of WWTP effluent?," *Proceedings of the Conference on Membranes in Drinking and Industrial Water Production*, vol. 2, pp. 105-112 (Oct. 2000).
Dunham, S. et al., "Membrane Cleaning Under the Microscope Successful Cleaning Means Knowing the Foulant," *Water Technology*, 4 pages (Sep. 1995).
Eltron Research, Inc., "In Situ Electrolytic System for Ultrafiltration Membrane Cleaning," (1 page abstract), date unknown.
Fazel, M. et al., "A statistical review of 150 membrane autopsies," 7 pages, date unknown.
Gotham, S. et al., "Model Studies of Food Fouling," pp. 1-13, date unknown.
Ghosh, R. et al., "Mass transfer in gas-sparged ultrafiltration: upward slug flow in tubular membranes," *Journal of Membrane Science*, vol. 162, Nos. 1-2, pp. 91-102 (Sep. 1, 1999) (1 page abstract).
Hong, S. et al., "Assessing pathogen removal efficiency of microfiltration by monitoring membrane integrity," *Water Science & Technology: Water Supply*, vol. 1, No. 4, pp. 43-48 (2001) (1 page abstract).
Huang, J. et al., "Pilot-plant study of a high recovery membrane filtration process for drinking water treatment," *Water Science and Technology*, vol. 41, Nos. 10-11, pp. 77-84 (2000) (1 page abstract).
Imasaka, T. et al., "Application of gas-liquid two-phase cross-flow filtration to pilot-scale methane fermentation," *Drying Technol.*, vol. 11, No. 4, pp. 769-785 (1993) (1 page abstract).
Jacangelo, J. et al., "The membrane treatment," *Civil Engineering*, 7 pages (Sep. 1998) http://www.pubs.asce.org/ceonline/sepfeat.html.
Jenkins, S. et al., "Fluorometric analysis of the uniformity of deposition on cassette membrane filters," *Appl. Occup. Environ. Hyg.*, vol. 7, No. 10, pp. 665-671 (1992) (1 page abstract).
Kennedy, M. et al., "Improving the performance of dead-end ultrafiltration systems: comparing air and water flushing," *Water Science and Technology: Water Supply*, vol. 1, No. 5/6, pp. 97-106 (2001).
Klein, G. et al., "Fouling in Membrane Apparatus: The Mechanisms of Particle Deposition," *Trans IChemE*, vol. 77, Part C, pp. 119-126 (Jun. 1999).
Laborie, S. et al., "Flux enhancement by a continuous tangential gas flow in ultrafiltration hollow fibers for drinnking water production: effects of slug flow on cake structure," *Filtr. Sep.*, vol. 34, No. 8, pp. 887-891 (1997) (1 page abstract).
Laborie, S. et al., "Fouling control by air sparging inside hollowing fiber membranes—effects on energy consumption," *Desalination*, vol. 118, No. 1-3, pp. 189-196 (1998) (1 page abstract).
Laborie, S. et al., "Characterisation of gas-liquid two-phase flow inside capillaries," *Chemical Engineering Science*, vol. 54, No. 23, pp. 5723-5735 (Dec. 1999) (1 page abstract).
Laitinen, N. et al., "Effect of filtration conditions and backflushing on ceramic membrane ultrafiltration of board industry wastewaters," *Separation and Purification Technology*, vol. 24, Nos. 1-2, pp. 319-328 (2001) (1 page abstract).
Makardij, A. et al,. "Microfiltration and ultrafiltration of milk: Some aspects of fouling and cleaning," *Trans IChemE*, vol. 77, Part C, pp. 107-113 (Jun. 1999).
"Market Engineering Measurement Analysis of the Total Ultrafiltration, Nanofiltration, and Reverse Osmosis Membrane Elements Market," *U.S. Ultrafiltration, Nanofiltration, and Reverse Osmosis Filter Element Markets 5318-15*, pp. 3-1-3-6 (2000).
Mercier, M. et al., "How slug flow can enhance the ultrafiltration flux in mineral tubular membranes," *Journal of Membrance Science*, vol. 128, pp. 103-113 (1997).
Mercier, M. et al., "Membrane bioreactors in fermentation process—two-phase flow may be a solution to enhance crossflow filtration flux," *BHR Group Conf. Ser. Publ.*, vol. 25, pp. 331-348 (1997) (1 page abstract).
Mercier, M. et al., "Yeast suspension filtration: flux enhancement using an upward gas/liquid slug flow—application to continuous alcoholic fermentation with cell recycle," *Biotechnol. Bioeng.*, vol. 58, No. 1, pp. 47-57 (1998) (1 page abstract).
Mercier-Bonin, M. et al., "Influence of a gas/liquid two-phase flow on the ultrafiltration and microfiltration performances: case of a ceramic flat sheet membrane," *Journal of Membrane Science*, vol. 180, No. 1, pp. 93-102 (2000) (1 page abstract).
Mercier-Bonin, M. et al., "Hydrodynamics of slug flow applied to cross-flow filtration in narrow tubes," *AIChE J.* vol. 46, No. 3, pp. 476-488 (2000) (1 page abstract).
Mercier-Bonin, M. et al., "How unsteady filtration conditions can improve the process efficiency during cell cultures in membrane bioreactors," *Separation and Purification Technology*, vol. 22 and 23, No. 1-3, pp. 601-615 (2001) (1 page abstract).

Mikulasek, P. et al., "The use of flux enhancement methods for high flux cross-flow membrane microfiltration systems," *Chemical and Biochemical Engineering Quarterly*, vol. 14, No. 4, pp. 117-123 (2000) (1 page abstract).
Mikulasek, P. et al., "Flux enhancement by gas-liquid two-phase flow for crossflow microfiltration in a tubular ceramic membrane," *J. Filtr. Soc.*, vol. 2, No. 1, pp. 20-26 (2001) (1 page abstract).
Nordman-Montelius, M. et al., "Analyses of Raw Milk Deposits on Non-Heated Polymer Surfaces," pp. 276-285, date unknown.
Paul, D. et al., "Membrane separation processes for clean production," *Environ. Prog.*, vol. 17, No. 3, pp. 137-141 (1998) (1 page abstract).
Paulson, D., Membranes, the Finest Filtration, *Filtration News*, http://www.osmonics.com/products/Page698.htm, 9 pages (Jul. 1, 1995).
Princeton Trade & Technology Inc., "Cleaners for Wastewater Ultrafiltration Membranes," (1 page abstract), date unknown.
Rogut, J., "Design and development of high performance gas-liquid membrane contactors for SO2 and NOx removal from flue gases," *Proc. Int. Tech. Conf. Coal Util. Fuel Syst.*, vol. 21, pp. 87-98 (1996) (1 page abstract).
Roorda, J. et al., "Understanding membrane fouling in ultrafiltration of WWTP-effluent," *Water Science and Technology*, vol. 41, No. 10-11, pp. 345-353 (2000).
Ruiz, J. et al., "Solid aerosol removal using ceramic filters," *Separation and Purification Technology*, vol. 19, No. 3, pp. 221-227 (Jul. 1, 2000) (1 page abstract).
Sandu, C. et al., "Fouling of Hearing Surfaces—Chemical Reaction Fouling Due to Milk," pp. 122-167, date unknown.
Scott, K. et al., "Intensified membrane filtration with corrugated membranes," *Journal of Membrane Science*, vol. 173, No. 1, pp. 1-16 (2000) (1 page abstract).
Serra, C. et al., "Use of air sparging to improve backwash efficiency in hollow-fiber modules," *Journal of Membrane Science*, vol. 161, No. 1-2, pp. 95-113 (2002) (1 page abstract).
Shimizu, Y. et al., "Filtration characteristics of hollow fiber microfiltration membranes used in membrane bioreactor for domestic wastewater treatment," *Water Res.*, vol. 30, No. 10, pp. 2385-2392 (1996) (1 page abstract).
"Standard Test Methods for Pore Size Characateristics of Membrane Filters by Bubble Point and Mean Flow Pore Test," pp. 1-7, date unknown.
"The Environmental Technology Centre," http://www.nottingham.ac.uk/~enzetc/technology/cmf.htm, 2 pages (Date Printed Mar. 21, 2003).
"The Environmental Technology Verification Program. ETV Joint Verification Statement," *U.S. Environmental Protection Agency*, pp. VS-i-VS-vi (Sep. 2000).
"U-Tube Reactor and Ultrafiltration Membrane," Water Pollution Control Technology in Japan, Nightoil Treatment, 3 pages (Date Printed Jun. 21, 2002) http://nett21.unep.or.jp/CTT_DATA/WATER/WATER_3/html/Water-165.html.
Väisänen, P. et al., "Treatment of UF membranes with simple and formulated cleaning agents," *Trans IChemE*, vol. 80, Part C, pp. 98-108 (Jun. 2002).
Verberk, J. et al., Combined air-water flush in dead-end ultrafiltration, *Proceedings of the Conference on Membranes in Drinking and Industrial Water Production*, vol. 2, pp. 655-663 (Oct. 2000).
Verberk, J. et al., "Combined air-water flush in dead-end ultrafiltration," *Water Science and Technology: Water Supply*, vol. 1, No. 5/6, pp. 393-402 (2001).
Verberk, J., "Air-water cleaning for micro and ultrafiltration," http://www.gezondheidstechniek.tudelft.nl\verberk.htm, 4 pages (Apr. 16, 2002).
Verberk, J, et al., "Hydraulic distribution of water and air over a membrane module using AirFlush®," *Water Science and Technology: Water Supply*, vol. 2, No. 2, pp. 297-304 (2002).
Verberk, J. et al., "Combined air-water flush in dead-end ultrafiltration," *TU Delft*, 1 page, date unknown.
Wang, Z. et al., "Characteristics of dextran and BSA fouling of PS membrane and its microscopic mechanism," *Shuichuli Jishu*, vol. 26, No. 5, pp. 273-276 (2000) (1 page abstract).

* cited by examiner

DELIVERY HEAD FOR MULTIPLE PHASE TREATMENT COMPOSITION, VESSEL INCLUDING A DELIVERY HEAD, AND METHOD FOR TREATING A VESSEL INTERIOR SURFACE

FIELD OF THE INVENTION

The invention relates to a delivery head for delivering multiple phase treatment composition to an interior surface of a vessel. The vessel can include equipment generally characterized as clean-in-place (CIP) equipment. The invention additionally relates to a method for treating a vessel interior surface by delivering a multiple phase treatment composition through a delivery head, and to a vessel that includes a delivery head for delivering multiple phase treatment composition to the interior surface of the vessel.

BACKGROUND OF THE INVENTION

Spray devices commonly referred to as spray balls are used to facilitate cleaning the interior surface of certain clean-in-place (CIP) equipment. Equipment that can be more quickly and cost effectively cleaned without disassembling the equipment is often referred to as clean-in-place equipment. Liquid cleaning compositions are typically run through clean-in-place equipment in order to provide cleaning. Exemplary facilities that utilize clean-in-place technology include dairy processing facilities, breweries, and chemical processing plants. Pipes and lines are often cleaned by running a cleaning composition therethrough. In order to reach the walls of vessels, spray balls are often used to project a liquid against the surface of the vessel. Exemplary types of vessels that are often cleaned with a spray device include tanks such as fermentation tanks, aging tanks, holding tanks, mixers, reactors, etc. Spray devices are often designed to distribute cleaning composition and rinse composition relatively uniformly to the upper surfaces of the vessel to be cleaned allowing the compositions to flow by gravity to the bottom where it is returned to the CIP unit or allowed to drain. The spray devices are often designed to provide complete coverage over all the interior surfaces of the vessel.

Two generally available types of spray devices for application of cleaning composition and rinse to the interior surfaces of a vessel include fixed (static) spray devices and rotating (dynamic) spray devices. Fixed spray devices are often used in sanitary applications because there are no moving parts to maintain or to break down and risk contamination. Fixed spray devices generally operate at low pressure (20-25 psig) on the principle of cascading water flow or sheeting over the interior surface of the vessel. Detergents can be provided to loosen the soil while the bulk solution flow flushes the soils away. Rotating spray devices generally operate at lower volumes and higher pressures (greater than 30 psig) but also rely on the cascading flow of the cleaning composition over the interior surface of the vessel for the removal of soil.

The use of a two-phase liquid/gas stream to clean pipelines is disclosed in European Patent Application 0 490 117 A1 to Kuebler that was published on Jun. 17, 1992. Kuebler describes cleaning pipelines using a two-phase liquid/gas stream and a reduction in throughput of the cleaning liquid by several orders of magnitude relative to conventional clean-in-place techniques.

Additional publications describing mixed phased flow include, for example, U.S. Pat. No. 6,326,340 to Labib et al.; U.S. Pat. No. 6,454,871 to Labib et al.; and U.S. Pat. No. 6,027,572 to Labib et al.

SUMMARY OF THE INVENTION

A delivery head is provided according to the invention. The delivery head includes a delivery arm and a spray diverter constructed to divert a multiple phase treatment composition flowing through the delivery arm and diverted by the spray diverter to provide a target spray pattern. The delivery head includes an open area sufficient to provide the target spray pattern and to provide a back pressure of less than about 10 psig when a multiple phase treatment composition is flowing through the delivery head at a liquid flow rate of about 2 gal/min. to about 20 gal/min., and the volumetric ratio of the gas to liquid is between about 5:1 and about 75,000:1 at atmospheric pressure.

A vessel is provided according to the invention. The vessel includes an interior surface arranged for holding a liquid, a multiple phase treatment composition inlet line, and at least one delivery head for delivering a multiple phase treatment composition to the interior surface. The vessel can include a plurality of delivery heads for providing desired treatment of the interior surface of the vessel. Exemplary vessels that can be treated include fermentation tanks, aging tanks, holding tanks, mixers, evaporators, and reactors.

A method for treating the interior surface of a vessel with a multiple phase treatment composition is provided according to the invention. The method includes a step of delivering a multiple phase treatment composition to a delivery head inside a vessel to create a target spray pattern that provides liquid from the multiple phase treatment composition onto an interior surface of the vessel.

DETAILED DESCRIPTION OF THE PREFERRED EMBODIMENTS

Figure 1:
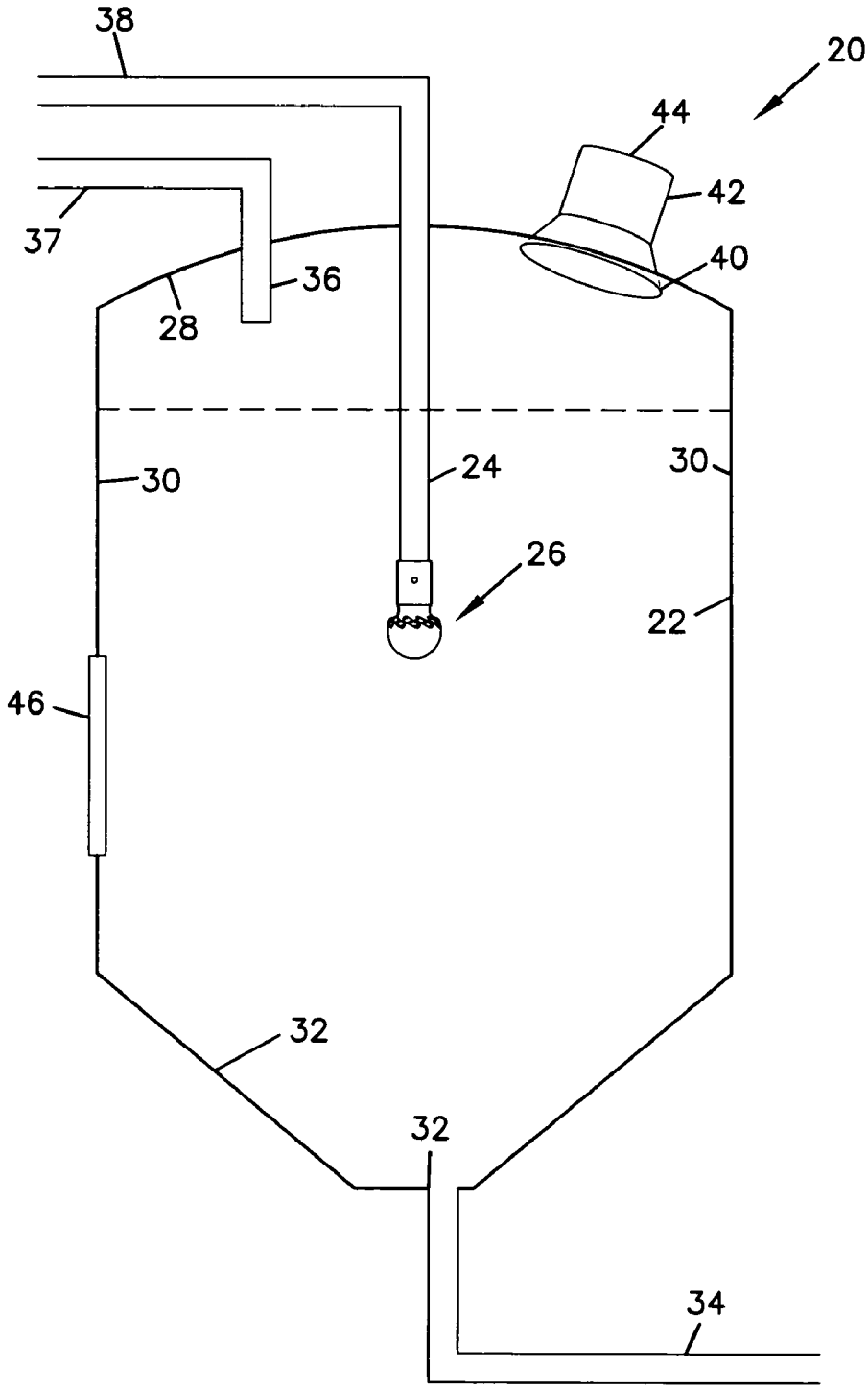
FIG. 1 is a diagrammatic view of a vessel that can be treated according to the principles of the present invention.

A delivery head can be provided for delivering a multiple phase treatment composition to the interior surface of a vessel. The vessel can be a type of clean-in-place (CIP) processing equipment, which means that it is generally designed to be cleaned without disassembly. That is, cleaning fluids are circulated through the CIP processing equipment in order to provide desired cleaning.

Conventional flow refers to a flooded hydraulic delivery system where the cleaning composition is diluted with water and allowed to flow over the surface to be cleaned. Conventional flow can be referred to as liquid flow and/or single phase flow. Liquid flow can be characterized by a general absence of a gaseous phase that provides for delivery of the liquid. It should be understood that the phrase "single phase flow" is not intended to exclude the existence of solids such as debris that may become a part of the liquid flow. Multiple phase flow refers to a system that utilizes a gaseous phase and a liquid phase wherein the gaseous phase is used to deliver the liquid phase. Multiple phase flow in the context of treating a surface refers to a system that utilizes a gaseous phase to deliver or carry a liquid to the surface for treatment. The treatment can include, for example, flushing, rinsing, pretreatment, cleaning, sanitizing, preserving, etc. The velocity and volume of the gaseous phase can be determined to provide desired contact between the liquid phase and the surface, resulting in a desired contact or coverage of the surface and/or any item on the surface such as soil or foulant. The desired gaseous velocity and volume will depend on the physical parameters of the surface to be cleaned including the size of the vessel to be treated.

Multiple phase flow refers to the generally concurrent delivery of a liquid phase and a gaseous phase. It should be understood that multiple phase flow refers to a media that contains a liquid phase and a gaseous phase. In general, multiple phase flow refers to a condition where the liquid phase is distributed or delivered by the gaseous phase. It should be understood that the phrase "generally concurrent delivery" refers to a generally steady state operation and is not intended to reflect a condition resulting from a transient start up of a conventional, liquid flow where there may be some initial mixing of gas with a liquid phase as a result of air being present in the lines, and is not intended to reflect a condition where there may be incidental bubbles present in a conventional, liquid flow.

The vessels that can be treated according to the invention include those vessels that are designed for periodic cleaning. Exemplary industries that include vessels that can be treated according to the invention include the food industry, the beverage industry, the biotechnology industry, the pharmaceutical industry, the chemical industry, and the water purification industry. In the case of food and beverage industries, products including milk, whey, fruit juice, beer, and wine are often processed in a vessel.

Multiple phase flow can be used to provide advantages compared with liquid flow. It should be understood that the reference to liquid flow refers to the general absence of a gaseous phase that suspends and transports a liquid phase. Compared to liquid flow, multiple phase flow can be used to deliver a higher concentration of chemical agent to a surface to increase the efficacy of the chemical agent. In many applications, it is expected that it would be too costly to use a highly concentrated chemical agent in liquid flow compared with multiple phase flow where a high concentration of chemical agent can be delivered to a surface relatively conveniently. It is expected that multiple phase flow can deliver a highly concentrated chemical to a surface without the waste associated with liquid flow. As a result, certain advantages resulting from the use of highly concentrated chemicals can be realized using multiple phase flow compared with liquid flow. In addition, by using the same amount of chemicals and/or active ingredients, a higher chemical concentration can be provided using multiple phase flow than liquid flow because the gaseous phase is the carrier or diluent in the multiple phase flow whereas water is typically the carrier or diluent in liquid flow. In addition, multiple phase flow can utilize less chemical agent and/or active ingredient than liquid flow, if desired. By using higher concentrated chemistry, it is expected that multiple phase flow can provide a desired effect in less time and/or provide an enhanced effect and/or can use less chemical agent compared with liquid flow. In addition, it should be understood that multiple phase flow can utilize the same amount of chemistry or active ingredient (or less) as liquid flow but can provide it at a higher concentration. By treating (such as, cleaning) faster, it is possible to increase production rate by decreasing the downtime of the equipment being treated. Furthermore, multiple phase flow can be used to provide an overall reduction in the amount of chemistry and/or active ingredient and water compared with liquid flow.

It should be understood that the use of the phrases liquid flow, single phase flow and multiple phase flow are not intended to exclude the presence of solids that may be present intentionally and/or as a result of foulants or debris that may become a part of the system. In addition, liquid flow can be referred to as flooded flow, and multiple phase flow can be referred to as non-flooded flow.

Now referring to FIG. 1, an exemplary vessel 20 is shown diagrammatically. The vessel 20 includes an interior surface 22, a treatment composition inlet line 24, and a spray device 26. Treatment composition provided as a multiple phase composition flows through the treatment composition inlet line 24 and the spray device 26 causing the multiple phase treatment composition to form a target spray pattern so that the liquid phase of the multiple phase treatment composition reaches the interior surface 22. The interior surface 22 includes a top surface 28, side walls 30, and bottom surface 32. The target spray pattern should be sufficient so that the liquid phase at least reaches the top surface 28 and the upper portions of the side surfaces 30. It is expected that desired spray patterns will additionally provide coverage of the bottom surface 32 and the lower portions of the side surface 30. However, it is expected that there may be a certain amount of movement of the liquid phase down the side wall 30 so that a chemical agent in the liquid phase will contact the bottom wall 32 and the bottom portion of the side wall 30. The movement of liquid phase down the side wall 30 can be referred to as a cascade effect. Based upon the expected flow rate of liquid phase down the side wall 30, it should be understood that the cascade effect is not expected to be as intense as the cascade effect encountered during single phase flow.

The vessel 20 additionally includes a liquid outlet 32. In general, it is expected that the liquid will flow into the liquid outlet 32 and will flow through the liquid outlet line 34 to a drain or to a recirculation line or to some type of further processing unit. It should be understood that vessels can include multiple liquid outlet lines. The liquid outlet can be used as an outlet for product. The vessel 20 additionally includes at least one product inlet line 36. Product can be introduced into the product inlet line 36 via the product line 37. In addition, multiple phase treatment composition can be introduced into the treatment composition inlet line 24 via the multiple phase treatment composition line 38.

The vessel 20 includes a vent 40 for venting gas such as air. Because of the large flow rate of multiple phase composition into the vessel 20, the gaseous phase can be vented through the vent 40. A demister 42 can be provided so that gas leaving the demister outlet 44 is relatively free of liquid phase. Accordingly, the demister 42 can include media that allows the liquid phase to condense thereon.

Vessels that are cleaned in place often include a man-way 46 that allows a person to enter into the vessel to clean the interior surface. It is expected that the use of a multiple phase treatment composition will help alleviate the need to provide for manual cleaning of the interior surface.

Figure 2:
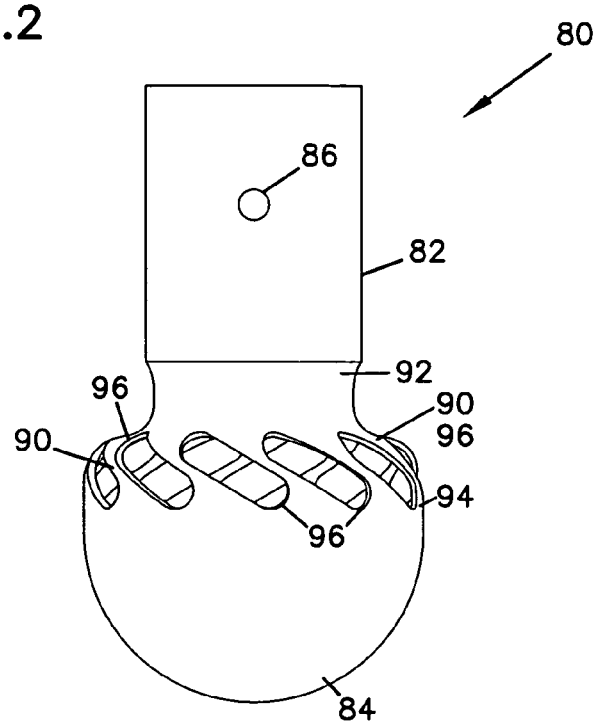
FIG. 2 is a side view of a delivery head for a multiple phase treatment composition according to the principles of the present invention.
Figure 3:
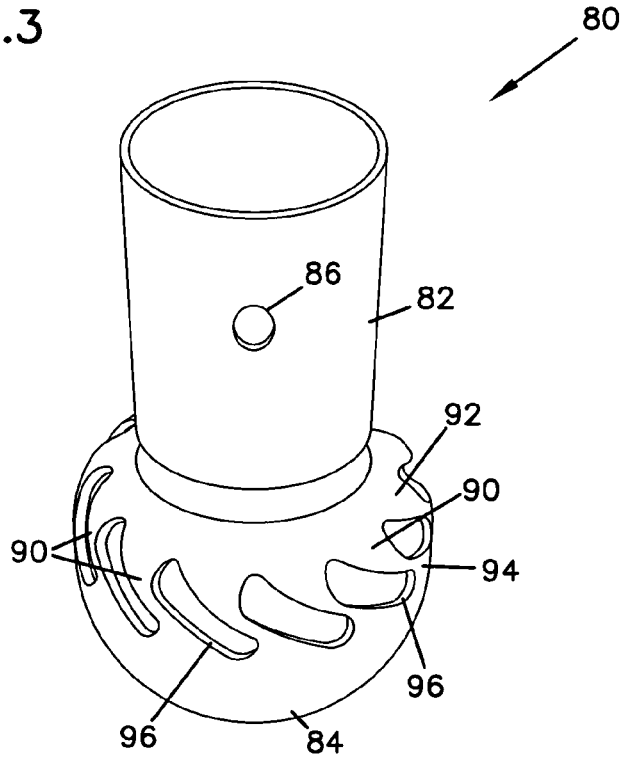
FIG. 3 is a perspective view of the delivery head of FIG. 3.

Now referring to FIGS. 2 and 3, an exemplary delivery head according to the invention is shown at reference number 80. The delivery head 80 includes a delivery arm 82 and a spray diverter 84. In general, the delivery arm 82 is constructed to attach to the treatment composition inlet line in a vessel. A pin opening 86 can be provided in the delivery arm 82 for attaching the delivery arm 82 to the treatment composition inlet line. That is, the treatment composition inlet line can be a pipe extending through the interior surface of a vessel. The pipe can have a hole through its side wall and the delivery arm 82 can fit coaxially with the pipe and a pin can be inserted through the pin opening 86 and the hole in the pipe to secure the delivery arm 82 in place. The delivery arm 82 can be provided so that it fits over the treatment composition inlet line. In addition, it is generally expected that the treatment composition inlet line will extend through the top wall of a vessel and typically downward into the vessel. It should be understood that various other techniques can be provided for attaching the delivery arm 82 to the treatment composition inlet line.

The delivery head 80 can include an attachment arm 90 having a first end 92 that attaches to the delivery arm 82 and a second end 94 that attaches to the spray diverter 84. As shown in the context of the delivery head 80, there is a plurality of attachment arms 90. The plurality of attachment arms 90 provide openings 96 through which multiple phase composition can flow to provide the desired spray pattern against the interior surface of the vessel.

The inventors found that conventional spray devices such as spray balls used for conventional liquid fail to provide a desired spray pattern when used for delivering a multiple phase treatment composition. It is believed that the reason for this is that conventional spray devices for use with liquid flow are designed to provide a back pressure sufficient to cause liquid flowing through the spray device to spray outward so that the streams of liquid contact the interior surface of the vessel. It is expected that the back pressure created inside the conventional spray device is at least about 25 psig during liquid flow to provide sufficient pressure so that the streams of liquid reach the side walls of the vessel. It is expected that the back pressure is created as a result of a relatively small open surface area for the liquid to escape. In contrast, the delivery head according to the invention provides for delivery of a liquid phase of a multiple phase composition to the interior walls of a vessel by avoiding a large back pressure in the spray head. The spray head can be designed so that the openings are sized to reduce back pressure to less than about 10 psig, and more preferably to less than about 5 psig, when a multiple phase composition is flowing through the delivery head at a liquid flow rate of about 2 gal/min. to about 20 gal/min., and the volumetric ratio of gas to liquid is between about 5:1 and about 75,000:1 at atmospheric pressure. In addition, it should be understood that the openings provide for flow of multiple phase treatment composition therethrough and can have any configuration or size sufficient to allow the multiple phase treatment composition to achieve the desired spray pattern and to allow the delivery head to achieve a back pressure of less than about 10 psig, and preferably less than about 5 psig. It should be understood that the back pressure refers to the differential pressure as measured inside the spray head and outside the spray head.

It should be understood that various treatment compositions and techniques that can be used according to the invention for application through the spray head for treating the interior surface of a vessel are described in U.S. application Ser. No. 10/786,238 that was filed with the United States Patent and Trademark Office on Feb. 23, 2004 and U.S. application Ser. No. 10/784,540 that was filed with the United States Patent and Trademark Office on Feb. 23, 2004. The entire disclosures of U.S. application Ser. No. 10/786,238 and U.S. application Ser. No. 10/784,540 are incorporated herein by reference in their entireties.

Figure 4:
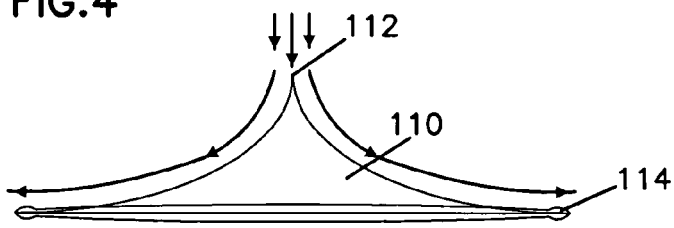
FIG. 4 is a diagrammatic view of an exemplary spray diverter according to the principles of the present invention.
Figure 5:
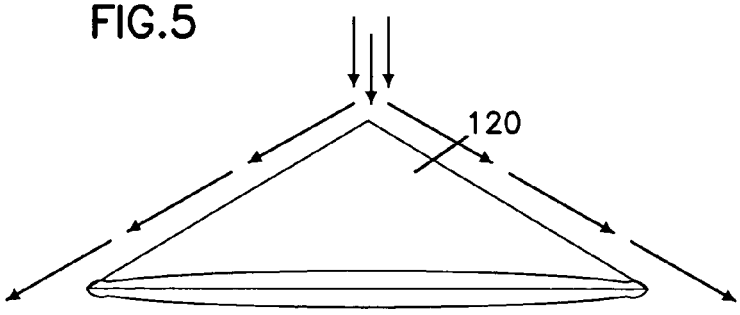
FIG. 5 is a diagrammatic view of an exemplary spray diverter according to the principles of the present invention.
Figure 6:
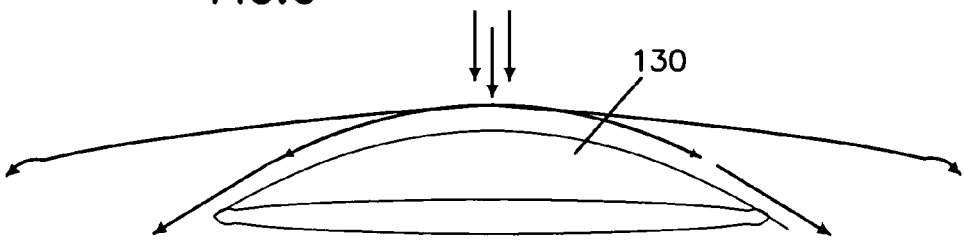
FIG. 6 is a diagrammatic view of an exemplary spray diverter according to the principles of the present invention.
Figure 7:
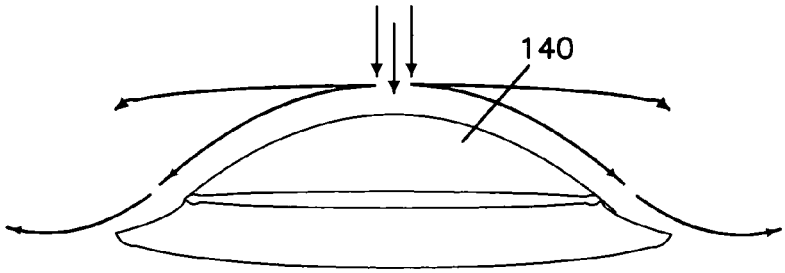
FIG. 7 is a diagrammatic view of an exemplary spray diverter according to the principles of the present invention.
Figure 8:
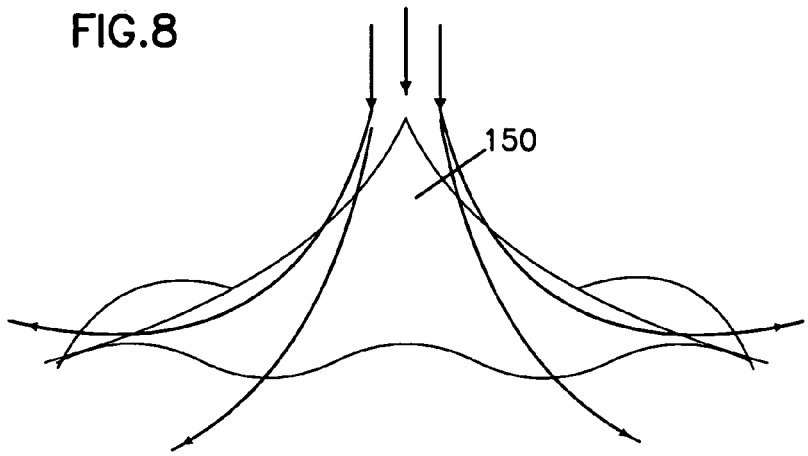
FIG. 8 is a diagrammatic view of an exemplary spray diverter according to the principles of the present invention.
Figure 9:
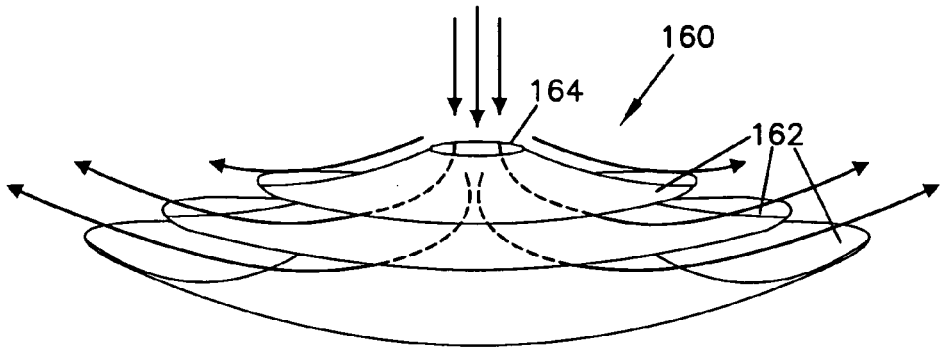
FIG. 9 is a diagrammatic view of an exemplary spray diverter according to the principles of the present invention.

Now referring to FIGS. 4-9, several spray diverter designs are shown. The arrows reflect the expected multiple phase treatment composition flow direction over the diverter surface. FIG. 4 shows a spray diverter 110 that causes multiple phase treatment composition to be directed radially outward. The spray diverter 110 includes a relatively central elevated area 112 that curves to the distribution area 114 around a circumference of the diverter. FIG. 5 shows a spray diverter 120 where the multiple phase treatment composition is directed conically downward. The spray diverter 120 can be characterized as having a conical shape. FIG. 6 shows a spray diverter 130 that can be characterized as having a spherical diverter surface for directing the multiple phase treatment composition both conically downward and radially outward. FIG. 7 shows a spray diverter 140. It is believed that the multiple phase treatment composition can be directed radially outward and possibly upward by the configuration of the spray diverter 140. FIG. 8 shows a spray diverter 150 having an oscillating diverter surface. It is expected that the change in contour of the diverter surface will cause the multiple phase treatment composition to flow in various directions to provide desired coverage of the interior surface of a vessel. FIG. 9 shows a spray diverter 160 that can be considered a series of concentric rings 162 and openings 164. The concentric rings can provide various radial applications of multiple phase treatment composition. It is expected that the multiple phase treatment composition can flow through the openings 164 and become diverted by the concentric rings 162. It should be understood that the shape and design of the spray diverter can be altered to provide the desired target spray pattern. In general, it should be understood that the spray pattern is a pattern desired for application of liquid phase from the multiple phase treatment composition to the interior surface of the vessel to provide desired coverage.

Figure 10:
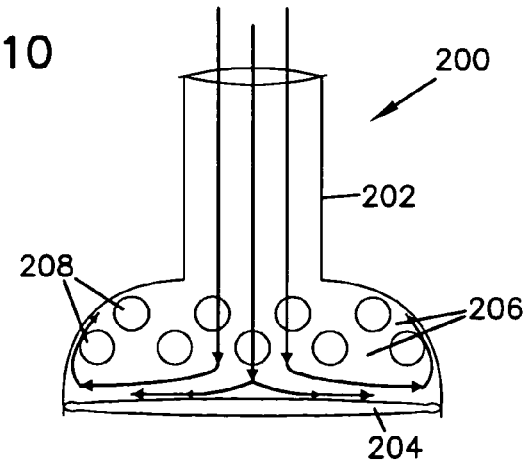
FIG. 10 is a diagrammatic, side view of a delivery head according to the principles of the present invention.

Now referring to FIG. 10, a delivery head is shown at reference number 200. The delivery head 200 includes a delivery arm 202 and a spray diverter 204. Attachment arm 206 is provided for holding the spray diverter 204 to the delivery arm 202. Openings 208 are provided for allowing the multiple phase treatment composition to flow out of the delivery head 200 in a desired pattern and to provide a sufficiently low back pressure within the delivery head 200.

Figure 11:
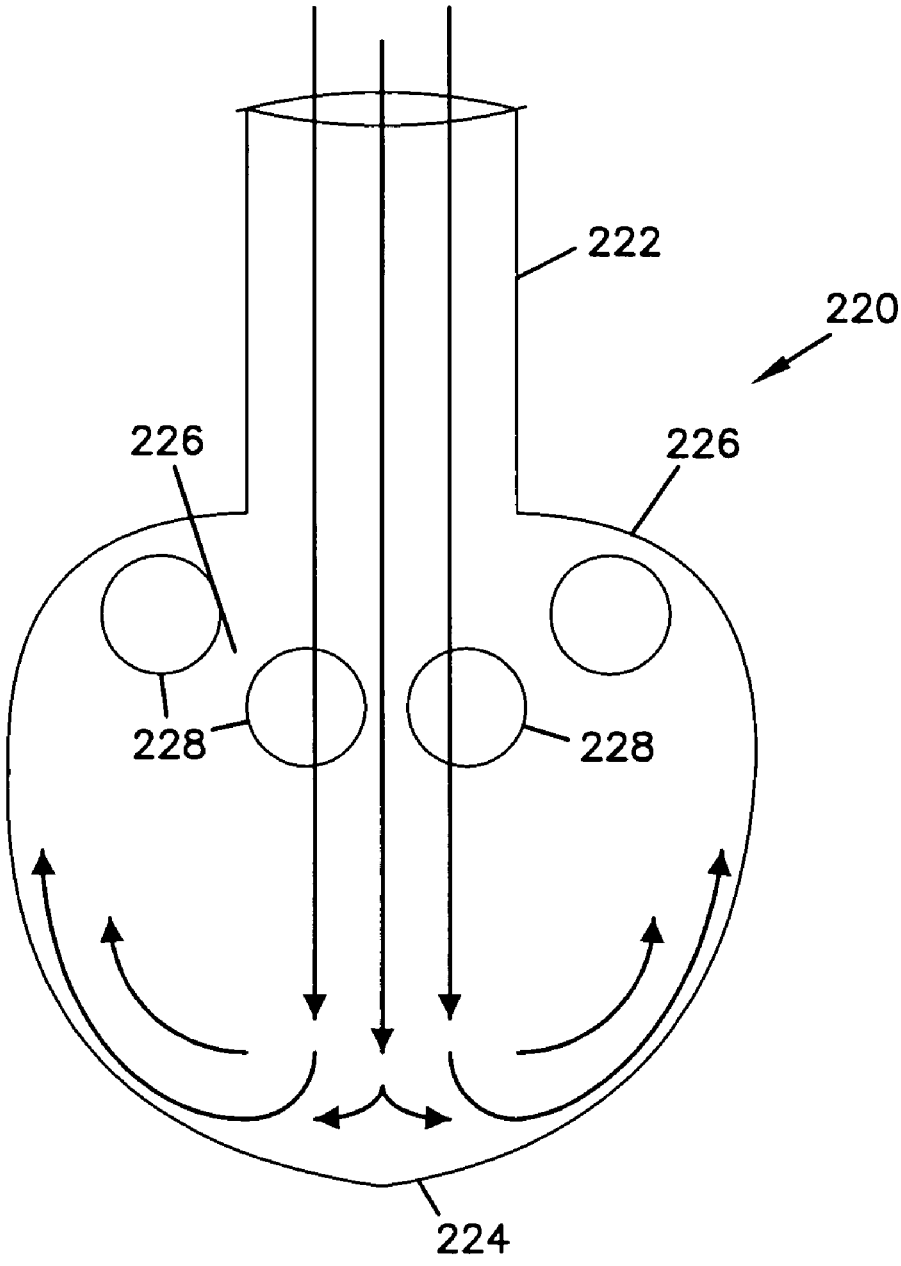
FIG. 11 is a diagrammatic, side view of a delivery head according to the principles of the present invention.

Now referring to FIG. 11, a delivery head is shown at reference number 220. The delivery head 220 includes a delivery arm 222, a spray diverter 224, and attachment arm 226. Openings 228 are provided to allow the multiple phase treatment composition to flow out of the delivery head 220 and to provide a sufficiently low back pressure within the delivery head 220.

Figure 12:
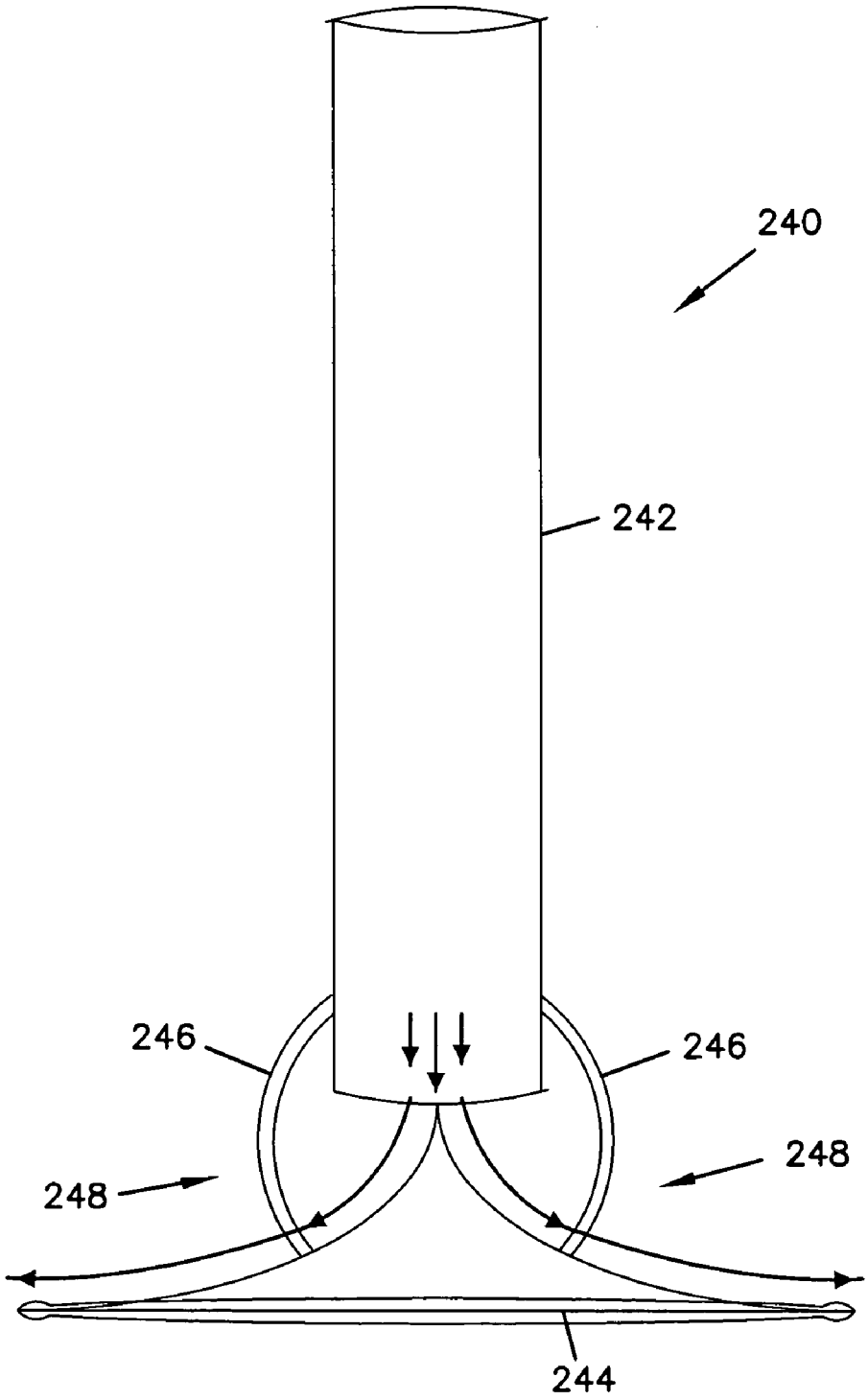
FIG. 12 is a diagrammatic, side view of an exemplary delivery head according to the principles of the present invention utilizing the spray diverter of FIG. 5.

Now referring to FIG. 12, a delivery head is shown at reference number 240. The delivery head 240 includes a delivery arm 242, a spray diverter 244, and attachment arms 246. The spray diverter 244 can be considered the spray diverter 110 from FIG. 4. Openings 248 are provided that allow the multiple phase treatment composition to flow out of the delivery head 240 and to help minimize back pressure within the delivery head 240.

The delivery head can be used for delivering the liquid phase of a multiple phase treatment composition to vessels having various sizes. It should be understood that the size (capacity) of the vessel depends in part on whether the vessel is characterized as a horizontal vessel or vertical vessel. In general, a vertical vessel has its longest axis that extends vertically, and a horizontal vessel has its longest axis extending horizontally. As a result, it may be possible to treat a vertical vessel using a single delivery head whereas the same sized vessel arranged horizontally would require more than one delivery head in order to reach all of the interior surface of the horizontal vessel. In addition, the flow rate of the multiple phase treatment composition and the design of the delivery head can effect the ability of the liquid phase to reach the interior surface of the vessel. In general, it is expected that a single delivery head can be used to treat vessels having a size of between about 200 gallon and about 5,000 gallon. Multiple delivery heads can be used to treat the interior surface of vessels having a size of about 3,000 gallon to about 50,000 gallon. The vessel can be any vessel used in processing including, for example, a fermentation tank, an aging tank, a holding tank, a mixer, an evaporator, and a reactor.

The following example was carried out to demonstrate principles of the present invention. It should be understood that the following example does not limit the invention.

EXAMPLE

A hose connected to the end of a line circuit was mounted and directed towards a foam wall 6 feet away to demonstrate the feasibility of a multiple phase cleaning equipment for wall or tank cleaning. A milk soil was developed by spraying whole milk on wall and allowing setting for 24 hours. Qualitatively, the multiple phase cleaning system appeared to effectively remove the dried on milk using 0.5% alkaline product (AC-101 from Ecolab Inc.) and Minfoam 2X

TABLE 1

| Inlet Pressure | Liquid Pump Setting | Liquid Flow Rate | Condition |
|---|---|---|---|
| 15 | 40 | 1.1 gpm | Good spray - good cascade effect |
| 15 | 30 | 0.8 gpm | Good spray - good cascade effect |
| 20 | 25 | 0.7 gpm | Good spray - good cascade effect |

Multiple phase cleaning was set up on the CIP line circuit and directed to the tank silo at the end of the 200 ft. line. The tank silo measures 6 ft. in height and 3 ft. in diameter. Traditional spray ball cleaning would require 28 gpm flow rate ($2\pi r \times 3.0 = 9.42$ ft.$\times 3.0$ gpm/ft=28 gpm) for adequate cleaning. The multiple phase cleaning appeared adequate at a flow rate of 0.7-1.1 gpm. The traditional spray ball was removed and replaced with an exhaust pipe with a capped end and large holes along the sides to minimize back pressure. A redesign of the spray head could maximize the multiple phase cleaning effect. Again, the tank wall was sprayed with whole milk and allowed to dry for 24 hours. The multiple phase spray was applied using only warm water and Minfoam 2X. Qualitative observations indicated the milk soil to be adequately removed and good cascading of the cleaning solution over the tank wall.

TABLE 2

| Inlet Pressure | Liquid Pump Setting | Liquid Flow Rate | Condition |
|---|---|---|---|
| 8 | 40 | 1.1 gpm | Good spray - good cascade effect |
| 8 | 2 | 0.6 gpm | Too much mist, not enough liquid |
| 1 | 25 | 0.7 gpm | Good spray - good cascade effect |

Initial qualitative results indicate the multiple phase flow equipment can adequately deliver cleaning solution to vessel walls allowing gravity and solution flow to clean tanks. There is an opportunity to reduce total volume required to clean tanks and vessels. Increased chemical concentration can be used because of the lower flow rates for multiple phase cleaning. In addition, heated cleaning composition could be used due to the minimal cooling effect that was noted. Spray heads could be engineered to effectively minimize back pressure and maximize cleaning composition volume delivery to the walls.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A vessel comprising:

(a) an interior surface arranged for holding a liquid;

(b) an inlet line for receiving and transporting a mixture of gas and liquid phases; and (c) at least one delivery head for delivering a multiple phase treatment composition in a generally upward and outward target spray pattern to the interior surface at a liquid flow rate of about 2 to about 20 gallons per minute and a volumetric ratio of gas to liquid of between about 5:1 and 75,000:1 at atmospheric pressure, wherein the delivery head comprises:

(i) a delivery arm attached to the inlet line, having an outlet from which the multiple phase treatment composition flows;

(ii) a spray diverter positioned with respect to the outlet of the delivery arm to divert the multiple phase treatment composition flowing from the outlet generally upward and outward to create the target spray pattern; and (iii) an open area positioned with respect to the spray diverter to allow passage of the multiple phase treatment composition and to provide a back pressure of less than about 10 psig.

2. A vessel according to claim 1, further comprising:

(a) at least one attachment arm having a first end attached to the delivery arm and a second end attached to the spray diverter.

3. A vessel according to claim 2, further comprising a plurality of the attachment arms.

4. A vessel according to claim 1, wherein the open area comprises a plurality of openings.

5. A vessel according to claim 1, wherein the delivery arm comprises a pin receiving slot.

6. A vessel according to claim 1, wherein the open area in the delivery head is sufficient to provide a back pressure of less than about 5 psig.

7. A vessel according to claim 1, further comprising a product inlet.

8. A vessel according to claim 1, further comprising a vent for venting gas from the multiple phase treatment composition.

9. A vessel according to claim 8, wherein the vent comprises a demister for recovering liquid phase from the multiple phase treatment composition.

10. A vessel according to claim 1, further comprising a liquid outlet for recovering liquid from inside the vessel.

11. A vessel according to claim 1, wherein the vessel comprises at least one of a fermentation tank, an aging tank, a holding tank, a mixer, an evaporator, and a reactor.

12. A vessel according to claim 1, wherein the vessel has a capacity of between about 200 gallons and about 5,000 gallons and includes a single delivery head.

13. A vessel comprising:

(a) a vessel body having an interior surface;

(b) an inlet line for receiving and transporting a mixture of gas and liquid phases; and (c) a delivery head located within the vessel body and spaced from the interior surface of the vessel body for delivering a multiple phase treatment composition in a generally upward and outward direction to contact the interior surface of the vessel body, wherein the delivery head comprises:

(i) a delivery arm joining the inlet line and the delivery head, having an opening from which the multiple phase treatment composition flows into the delivery head;

(ii) a spray diverter located within the delivery head and spaced from the delivery arm opening for diverting the multiple phase treatment composition flowing from the delivery arm generally upward and outward to contact the interior surface of the vessel body; and (iii) at least one opening spaced from the spray diverter to allow passage of the multiple phase treatment composition from the delivery head to the interior surface of the vessel body, wherein a liquid flow rate of about 2 to about 20 gallons per minute and a volumetric ratio of gas to liquid of between about 5:1 and 75,000:1 at atmospheric pressure provides a back pressure of less than about 10 psig.

14. The vessel according to claim 13, wherein a liquid flow rate of about 2 to about 20 gallons per minute and a volumetric ratio of gas to liquid of between about 5:1 and 75,000:1 at atmospheric pressure provides a back pressure of less than about 5 psig.

15. A vessel comprising:

(a) a vessel body defining an interior chamber and suitable for containing flow of a liquid;

(b) an inlet line for receiving and transporting a mixture of gas and liquid phases; and (c) a delivery head located in an open area within the interior chamber for delivering a multiple phase treatment composition to an interior surface of the vessel, wherein the delivery head comprises;

(i) a delivery arm for receiving flow of a multiple phase treatment composition from the inlet line and directing the flow through the delivery head;

(ii) at least one opening to allow passage of the multiple phase treatment composition from the delivery head to the interior surface of the vessel in a generally upward and outward direction; and (iii) a spray diverter positioned with respect to the delivery arm and the at least one opening to divert the multiple phase treatment composition in a generally upward and outward direction to contact the interior surface of the vessel, wherein the spray diverter provides a back pressure of less than about 10 psig when the multiple phase treatment composition is flowing through the delivery head at a liquid flow rate of about 2 to about 20 gallons per minute and has a volumetric ratio of gas to liquid of between about 5:1 and 75,000:1 at atmospheric pressure.

16. The vessel according to claim 15, wherein the spray diverter provides a back pressure of less than about 5 psig when the multiple phase treatment composition is flowing through the delivery head at a liquid flow rate of about 2 to about 20 gallons per minute and has a volumetric ratio of gas to liquid of between about 5:1 and 75,000:1 at atmospheric pressure.

* * * * *